US010374374B2

(12) United States Patent
Kaandorp

(10) Patent No.: US 10,374,374 B2
(45) Date of Patent: Aug. 6, 2019

(54) LAMP BASE ALLOWING FOR ELECTRICAL CONTACT IN VARIOUS ROTATIONAL POSITIONS

(71) Applicant: SIGNIFY HOLDING B.V., Eindhoven (NL)

(72) Inventor: Wouter Petrus Kaandorp, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 16 days.

(21) Appl. No.: 15/309,687

(22) PCT Filed: May 5, 2015

(86) PCT No.: PCT/EP2015/059767
§ 371 (c)(1),
(2) Date: Nov. 8, 2016

(87) PCT Pub. No.: WO2015/169770
PCT Pub. Date: Nov. 12, 2015

(65) Prior Publication Data

US 2017/0149188 A1 May 25, 2017

(30) Foreign Application Priority Data

May 9, 2014 (EP) ..... 14167609

(51) Int. Cl.
*F21K 9/235* (2016.01)
*H01R 33/22* (2006.01)
(Continued)

(52) U.S. Cl.
CPC ..... *H01R 33/22* (2013.01); *F21K 9/23* (2016.08); *F21K 9/235* (2016.08); *H01R 2103/00* (2013.01); *H01R 2201/08* (2013.01)

(58) Field of Classification Search
CPC . F21K 9/23; F21K 9/233; F21K 9/238; F21K 9/272; F21K 9/278; F21V 19/005;
(Continued)

(56) References Cited

U.S. PATENT DOCUMENTS 1,957,821 A 5/1934 Drake
3,215,972 A 11/1965 Eriksson
(Continued)

FOREIGN PATENT DOCUMENTS

CN 200986148 Y 12/2007
CN 202132757 U 2/2012
(Continued)

*Primary Examiner* — Anh T Mai
*Assistant Examiner* — Steven Y Horikoshi
(74) *Attorney, Agent, or Firm* — Akarsh P. Belagodu

(57) ABSTRACT

The present invention relates to a screw-in type base for a lighting device being arranged to be mounted in a socket comprising a socket bottom conductor is provided. The base (100, 200, 300) comprising a threaded tubular enclosure (102) extending along an axial direction between a first (102*a*) and a second (102*b*) end portion of the enclosure (102), a base bottom conductor (103, 203, 311) arranged to be in electrically conductive contact with a light source (106) of the lighting device (400), and arranged to make electrically conductive, biased contact with the socket bottom conductor when the lighting device (400) is mounted in the socket, wherein the base bottom conductor (103, 203, 311) comprises a compliant thin-walled member (105, 205, 308) arranged such that the base bottom conductor (103, 203, 311) is, relative to the enclosure (102), movable in the axial direction in response to engagement with the socket bottom conductor when the lighting device (400) is mounted in the socket. The present invention also relates to a lighting device (400) comprising the base.

11 Claims, 3 Drawing Sheets

(51) Int. Cl.
*F21K 9/23* (2016.01)
*H01R 103/00* (2006.01)

(58) Field of Classification Search
CPC ..... F21V 19/006–007; F21V 19/04; F21V 19/042; F21V 23/04; F21V 25/04; F21V 17/164; H01R 33/20; H01R 33/22; H01R 33/46; H01R 33/962; H01R 13/71; H01J 5/54; H01J 5/56; H01J 5/565; H01J 5/58; H01J 5/60; H01J 5/62
See application file for complete search history.

(56) References Cited

U.S. PATENT DOCUMENTS

| | | | |
|---|---|---|---|
| 8,147,267 | B2 | 4/2012 | Oster |
| 2010/0141144 | A1 | 6/2010 | Hofmann et al. |
| 2012/0058663 | A1 | 3/2012 | Oster |
| 2012/0236602 | A1 | 9/2012 | Flaherty et al. |

FOREIGN PATENT DOCUMENTS

| | | | |
|---|---|---|---|
| KR | 914507 | U | 9/2009 |
| KR | 2010006235 | A | 1/2010 |
| KR | 997891 | B1 | 12/2010 |
| KR | 20110074134 | A | 6/2011 |

LAMP BASE ALLOWING FOR ELECTRICAL CONTACT IN VARIOUS ROTATIONAL POSITIONS

CROSS-REFERENCE TO PRIOR APPLICATIONS

This application is the U.S. National Phase application under 35 U.S.C. § 371 of International Application No. PCT/EP2015/059767, filed on May 5, 2015, which claims benefit of European Patent Application No. 14167609.8, filed on May 9, 2014. These applications are hereby incorporated by reference herein.

FIELD OF THE INVENTION

The present inventive concept relates to a screw-in type base for a lighting device and a lighting device comprising such a base.

BACKGROUND OF THE INVENTION

Lighting devices, such as incandescent light bulbs and light emitting diodes LED lamps are available in various designs. Some lighting device designs are compatible with existing lighting fixtures and sockets. For example, a lighting device may be provided with a threaded base which may be screwed into a socket, i.e. an Edison screw fitting. Such a lighting device comprising a threaded base needs to be hand-tightly fixed to the socket to ensure electrical connection to the socket such that the light source of the lighting device may be powered.

The lighting devices that are currently available on the market are predominantly rotational symmetric. The light emission and visual appearance of such a lighting device does not significantly depend on the rotational angle of the lighting device after it is screwed into the socket of a luminaire. In other words, the actual rotational position of the lighting device, after it is hand-tightly fixed to the socket, does therefore not influence the visual appearance of the luminaire. This same reasoning holds for a lighting device having a rotational symmetric light emission, since the directionality of the light emitted from the luminaire is not affected by the rotational position of the light source.

If, however, the lighting device and/or its light emission is rotationally asymmetric the visual appearance and/or directionality of the light emission depend on the rotational angle of the lighting device.

A lighting device provided with a threaded base is typically screwed into a socket until it makes electrical contact and is hand-tight. However, the appearance of a lighting device being rotationally asymmetric or the light emission of a lighting device having a rotationally asymmetric light emission may be pointed at a non-ideal angle when screwed into the socket.

Hence, it is desirable to be able to rotationally adjust the position of the lighting device or to direct its light emission by turning the lighting device.

It may be possible to turn the lighting device somewhat to aim it correctly but that will loosen the device in the socket and may diminish or even break the electrical connection. This condition could either cause the light to go out, or result in a poor electrical connection that gets hot and creates a fire hazard.

In U.S. Pat. No. 8,147,267 a solution to this problem is presented. According to U.S. Pat. No. 8,147,267 a spring coil biased movable conductor mounted in the center of the base is used in order to solve the problem of being able to turn a rotationally asymmetric lighting device with retained good electrical connection between the lighting device and the socket.

However, there is a need to find new means to direct asymmetric lighting devices with a screw-in type base.

SUMMARY OF THE INVENTION

It is an object of the present invention to provide new means to direct asymmetric lighting devices with a screw-in type base. Such a screw-in type base shall preferably also be designed to be easy and cheap to manufacture. The reduction in number of parts required and the reduced complexity in assembly contribute towards the reduction of cost.

According to a first aspect of the invention, these and other objects are achieved by providing a screw-in type base for a lighting device being arranged to be mounted in a socket comprising a socket bottom conductor. The base comprising a threaded tubular enclosure extending along an axial direction between a first and a second end portion of the enclosure; a base bottom conductor arranged to be in electrically conductive contact with a light source of the lighting device, and arranged to make electrically conductive, biased contact with the socket bottom conductor when the lighting device is mounted in the socket, wherein the base bottom conductor comprises a cylindrical compliant thin-walled member partly embedded in the base and arranged such that the base bottom conductor is, relative to the enclosure, movable in the axial direction in response to engagement with the socket bottom conductor when the lighting device is mounted in the socket.

By providing a base bottom conductor that is axially movable, in relation to the enclosure, the base may be rotated in the socket without reducing or breaking the electrical contact between the base bottom conductor and the socket bottom contact. It is thereby possible to rotationally adjust the position of the lighting device or to direct its light emission by turning the base in the socket.

The biased contact between the base and the socket further mitigates that the base becomes loose in the socket.

The compliant thin-walled member further reduces the building height needed for forming the base.

The wording compliant thin-walled member should be construed as a substantially flat or dome shaped structure that is conformed as a result of forces being exerted on it. In other words, the compliant thin-walled member is resilient such that it is able to substantially recoil or spring back into shape after bending, stretching, or being compressed. Hence, the compliant thin-walled member is flexible and at least partly elastically deformable. The material of which the compliant thin-walled member is composed of may be resilient. The compliant thin-walled member may alternatively be shaped such that it provides a resilient structure.

The compliant thin-walled member may be overmolded during production to further reduce the number of parts required to secure the compliant member to the lamp base/cap.

The base bottom conductor may be centrally arranged in the base. This makes the base rotationally symmetric which simplifies the mounting of the base in the socket.

The base bottom conductor may be in electrically conductive contact with the light source of the lighting device via an electrically conductive wire. This provides efficient assembly of the lighting device and ensures efficient contacting of the lighting device such that it may be powered when mounted in the socket. The use of the electrically conductive wire for establishing electrically conductive contact between the base bottom conductor and the light source also provide for such that the base bottom conductor may be moved in relation to the light source which typically is fixed in relation to the tubular enclosure.

The base bottom conductor may further comprise an electrically conducting contact pin, and the base may further comprise an insulator attached to the first end portion of the enclosure, the insulator having an inner portion facing towards an inner space of the enclosure, an outer portion facing away from the inner space, and a channel for receiving the electrically conducting contact pin, the channel extending from the outer portion, through the insulator and leading into the inner space, wherein the compliant thin-walled member is arranged in the inner space. This arrangement has the advantage that the base may have an appearance that resembles known lamp bases such as the Edison screw mount or the Casun cap. The compliant thin walled member may by being in the inner space of the enclosure be better protected from external forces that may mechanically damage the compliant thin walled member. A more durable base may thereby be obtained.

A further advantage of the compliant thin-walled member is that less space is used within the lamp base/cap to locate the contact than is required in the prior art devices.

The contact pin may be attached to the compliant thin-walled member. This is advantageous as it may simplify the assembly of the base. The contact pin is further held in position by the compliant thin-walled member which mitigates problems associated with the contact pin becoming loose in the base.

The compliant thin-walled member may comprise an electrically conducting material. The electrical contact between the base and the socket may thereby be facilitated by the compliant thin-walled member. In other words, the compliant thin-walled member may constitute the base bottom conductor.

The electrically conducting wire may be in electrical connection with the compliant thin-walled member. This simplifies assembly of the bas and ensures efficient contacting of the lighting device such that it may be powered when mounted in the socket. The electrically conducting wire may further be compliant to the movement of the thin-walled member.

The electrically conducting wire may be attached to the contact pin.

The base may further comprise an insulator attached to the first end portion of the enclosure, the insulator having an inner portion facing towards an inner space of the enclosure and an outer portion facing away from said inner space, wherein the compliant thin-walled member is arranged at the outer portion of the insulator. This arrangement further reduces the building height needed to form the base.

The base may further comprise a shell in which the compliant thin-walled member is formed. The shell may thereby provide stability to the compliant thin-walled member.

The shell may be partly embedded in the insulator, which simplifies manufacturing of the base.

According to a second aspect a lighting device is provided. The lighting device comprising a base according to any one of the above embodiments and a lighting module arranged on the base. The function and benefits of using a lighting device comprising the base are described above. The above mentioned features, when applicable, apply to this second aspect as well. In order to avoid undue repetition, reference is made to the above.

It is noted that the invention relates to all possible combinations of features recited in the claims.

BRIEF DESCRIPTION OF THE DRAWINGS

This and other aspects of the present invention will now be described in more detail, with reference to the appended drawings showing embodiments of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
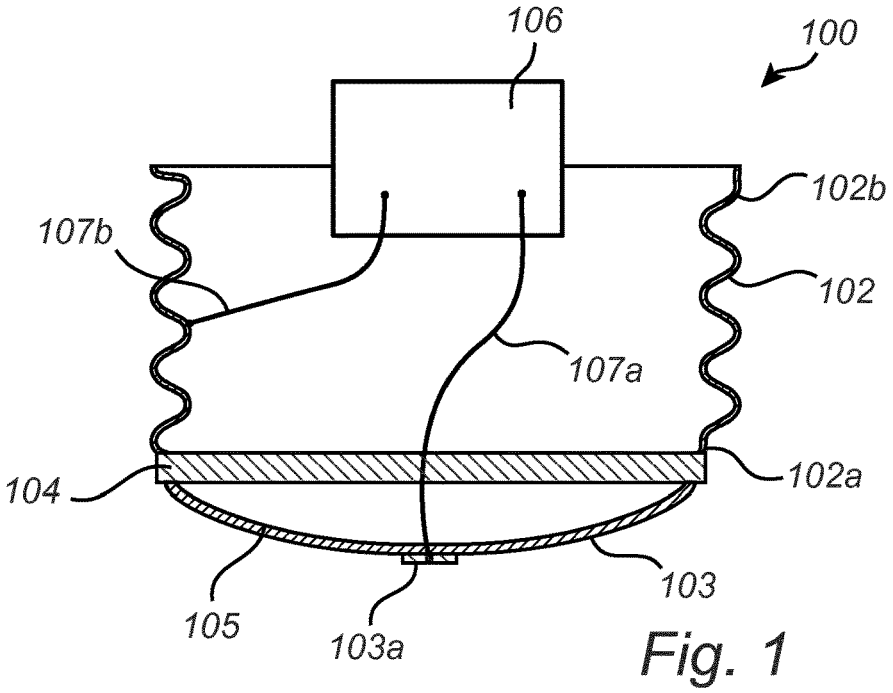
FIG. 1 illustrates a cross-sectional side view of a base according to one embodiment of the present invention.

FIG. 1 illustrates a screw-in type base 100 for a lighting device according to an embodiment of the present invention. The base 100 is arranged to be mounted in a socket comprising a socket bottom conductor. The socket is for clarity not shown. The base 100 comprises a threaded tubular enclosure 102 extending along an axial direction between a first 102*a* and a second 102*b* end portion of the enclosure 102 and a base bottom conductor 103. The threaded tubular enclosure 102 and the base bottom conductor 103 are electrically conductive. Typically the threaded tubular enclosure 102 and the base bottom conductor 103 comprise metals.

It should be noted that the socket may comprise threads corresponding to the threads of the enclosure 102. The outer dimensions of the enclosure 102 and the corresponding inner dimensions of the socket may by way of example correspond to those of the E14 or E27 Edison screw fitting.

The enclosure 102 and the base bottom conductor 103 are electrically isolated from each other by an insulator 104.

The base bottom conductor 103 is further in electrically conductive contact with a light source 106 of the lighting device via an electrically conductive wire 107*a*. The tubular enclosure 102 is in electrically conductive contact with the light source 106 of the lighting device via an electrically conductive wire 107*b*. The wires 107*a*, 107*b* ensure efficient contacting of the lighting source 106 such that the lighting device may be powered when mounted in the socket. The electrically conductive wire 107*a* has preferably a length that is at least as large as the distance the base bottom conductor 103 may move in response to engagement with the socket bottom conductor when the lighting device is mounted in the socket.

The insulator 104 may comprise a polymer material, such as an engineering thermoplastic, for instance, polybutylene terephthalate (PBT) or polycarbonate (PC), a glass or a ceramic material. The insulator 104 may advantageously be injection molded.

The base bottom conductor 103 further comprises a compliant thin-walled member 105. The compliant thin-walled member 105 forms the base bottom conductor 103 and has a bulging portion 103*a* which is arranged to make an electrically conductive contact with the socket bottom conductor. The compliant thin-walled member 105 may comprise stainless steel. As an inherent feature of the thin-walled member 105 being compliant the thin-walled member 105 is resilient. As a result of the compliant thin-walled member 105 being resilient, the compliant thin-walled member 105, and especially the bulging portion 103*a*, may move in an, relative to the enclosure 102, axial direction in response to engagement with the socket bottom conductor when the lighting device is mounted in the socket.

The compliant thin-walled member 105 disclosed in FIG. 1 has a dome shape which provides a resilient structure. By this arrangement a base bottom conductor 103 is provided which ensures a biased electrically conductive contact with the socket bottom conductor. Hence a base bottom conductor 103 that is axially movable, in relation to the tubular enclosure 102 is provided. The base 100 may therefore be rotated in the socket without reducing or breaking the electrical contact between the base bottom conductor 103 and the socket bottom conductor. It is thereby possible to rotationally adjust the position of the lighting device or to direct its light emission by turning the base 100 in the socket.

The biased contact provided between the base 100 and the socket further mitigates that the base 100 becomes loose in the socket.

Hence, the base bottom conductor 103 may be set in an extended position and a compressed position and any position there between. The distance between the extended position and the compressed position is preferably being large enough such that the base 100 of the lighting device may be rotated at least 180 degrees. In other words, base bottom conductor 103 may move a distance that corresponds to at least half the height of the tread of the treaded tubular enclosure 102, without reducing or breaking the electrical contact between the base bottom conductor 103 and the socket bottom contact.

Depending on the symmetry of the lighting device, in another embodiment the distance between the extended position and the compressed position may be smaller than the above mentioned distance corresponding to at least half the height of the tread of the treaded tubular enclosure 102. For example the distance between the extended position and the compressed position of the base bottom conductor 103 may be set such that the base 100 may be rotated for example anywhere between 0-180 degrees with remaining contact between the base bottom conductor 103 and the socket bottom conductor.

The base bottom conductor 103 is further centrally arranged in the base 100. This makes the base 100 rotationally symmetric which simplifies the mounting of the base 100 in the socket.

According to another embodiment an electrically conducting wire may be in electrically conductive contact with the compliant thin-walled member.

The compliant thin-walled member 105 and the bulge 103*a* may further be joined together. They may e.g. be joined by welding or gluing them together.

The person skilled in the art understands that the compliant thin-walled member may flexible and biased in different ways than illustrated in FIG. 1. The thin-walled member may for example comprise biased resilient plate like structure similar to the one illustrated in FIG. 2.

Figure 2:
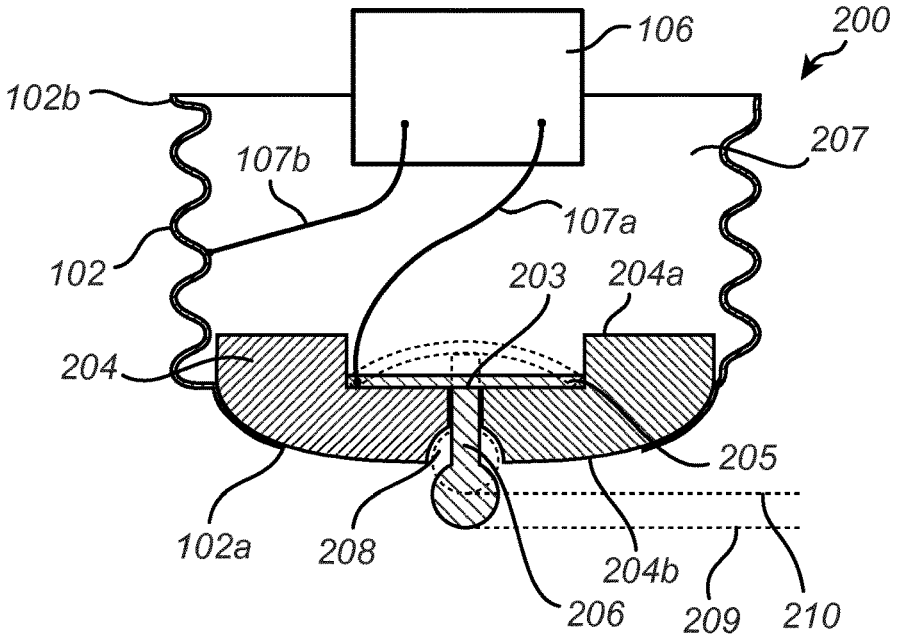
FIG. 2 illustrates a cross-sectional side view of a base according to another embodiment of the present invention.

FIG. 2 illustrates a screw-in type base 200, according to another embodiment of the present invention, for a lighting device being arranged to be mounted in a socket. The socket comprising a socket bottom conductor is for clarity not shown.

The base 200 comprises a threaded tubular enclosure 102 extending along an axial direction between a first 102*a* and a second 102*b* end portion of the enclosure 102, a base bottom conductor 203, and an isolator 204.

The base bottom conductor 203 comprises a compliant thin walled member 205 and an electrically conducting contact pin 206. The insulator 204 is attached to the first end portion 102*a* of the enclosure 102, such that the isolator 204 has an inner portion 204*a* facing towards an inner space 207 of the enclosure 102 and an outer portion 204*b* facing away from the inner space 207. The isolator 204 further comprises a channel 208 for receiving the electrically conducting contact pin 206. The channel 208 extends from the outer portion 204*b*, through the insulator 204 and leads into the inner space 207.

The compliant thin walled member 205 is arranged in the inner space 207 of the enclosure 102 such that it may be better protected from external forces that may mechanically damage it. A more durable base 200 may thereby be obtained.

The contact pin 206, made of electrically conducting material, may further attached or joined to the compliant thin-walled member 205. The contact pin 206 may e.g. be attached or joined to the compliant thin-walled member 205 by means of welding or gluing. The contact pin 206 is thereby held in position by and in electrical contact with the compliant thin-walled member 205. The contact pin 206 is thereby hindered from falling out of the base 200.

The compliant thin-walled member 205 may be made of an electrically conducting material such as stainless steel. In case of the thin-walled member 205 being made of electrically conducting material the electrical contact between the contact pin 206 and the socket may be facilitated via the thin-walled member 205.

An electrically conducting wire 107*a* is further arranged in the inner space 207 of the base 200 and is in electrical connection with the compliant thin-walled member 205. Hence, efficient contacting of the lighting device may be provided such that the lighting device may be powered when mounted in the socket. The electrically conducting wire 107*a* is as discussed above compliant to the movement of the thin-walled member 205.

The thin-walled member 205 is formed as a resilient plate like structure. The thin-walled member 205 further biases the contact pin 206 such that the contact pin 206 is in an extended position 209 when no external force is applied to it.

As the compliant thin-walled member 205 is resilient it and the contact pin 206 are axially movable in relation to the tubular enclosure 102. When an external force is applied to the contact pin 206, such as when the base 200 is mounted in the socket, the compliant thin-walled member 205 may bend. As a result, the compliant thin walled member is moved away from the inner portion 204*a* of the isolator 204 and the contact pin 206 reaches a compressed position 210. The base bottom conductor 203 is thereby arranged such that the base 200 may be rotated in the socket without reducing the efficiency in powering the lighting device.

Hence, the base bottom conductor 203 may be set in the extended position 209 and the compressed position 210 and any position there between. The distance between the extended position 209 and the compressed position 210 is preferably being large enough such that the base 200 of the lighting device may be rotated at least 180 degrees. In other words, the contact pin 206 may move a distance that corresponds to at least half the height of the tread of the treaded tubular enclosure 102, without reducing or breaking the electrical contact between the base bottom conductor 203 and the socket bottom contact.

As describe above, depending on the symmetry of the lighting device, in another embodiment the distance between the extended position 209 and the compressed position 210 may be smaller than the above mentioned distance corresponding to at least half the height of the tread of the treaded tubular enclosure 102.

The electrically conducting wire may alternatively be attached to the contact pin. This is for example advantageous if the compliant thin-walled member comprises an electrically non-conducting material.

According to other embodiments the compliant thin-walled member may comprise a compressible resilient material. The compliant thin-walled member may comprise a resilient membrane such as silicone. The silicone may further be electrically conductive.

Figure 3:
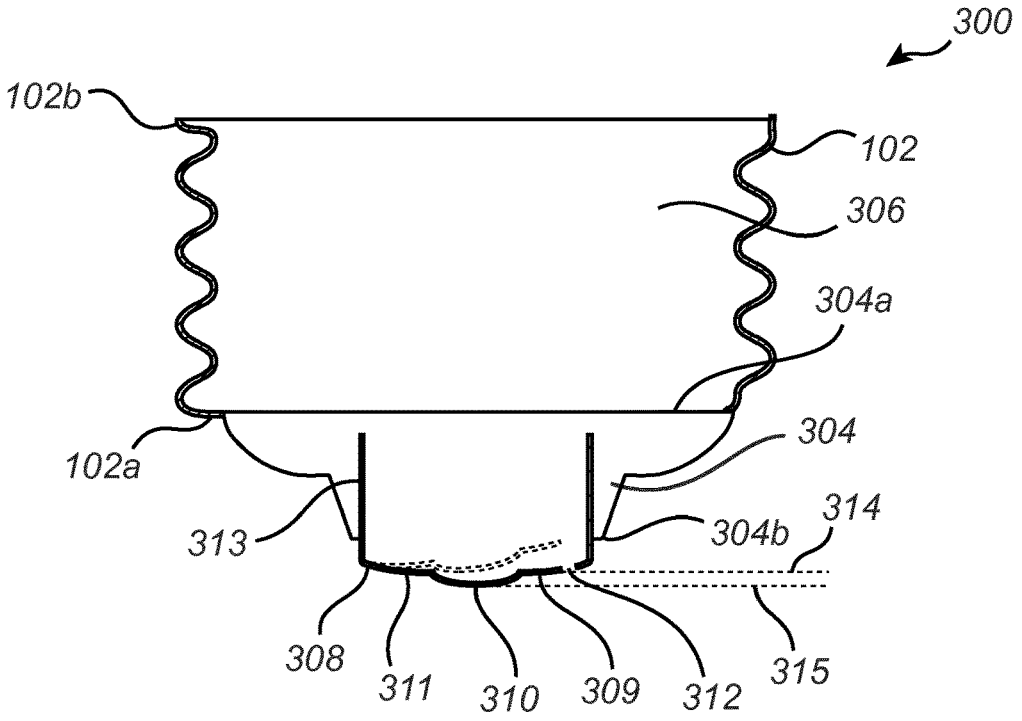
FIG. 3 illustrates a cross-sectional side view of a base according to yet another embodiment of the present invention.
Figure 4:
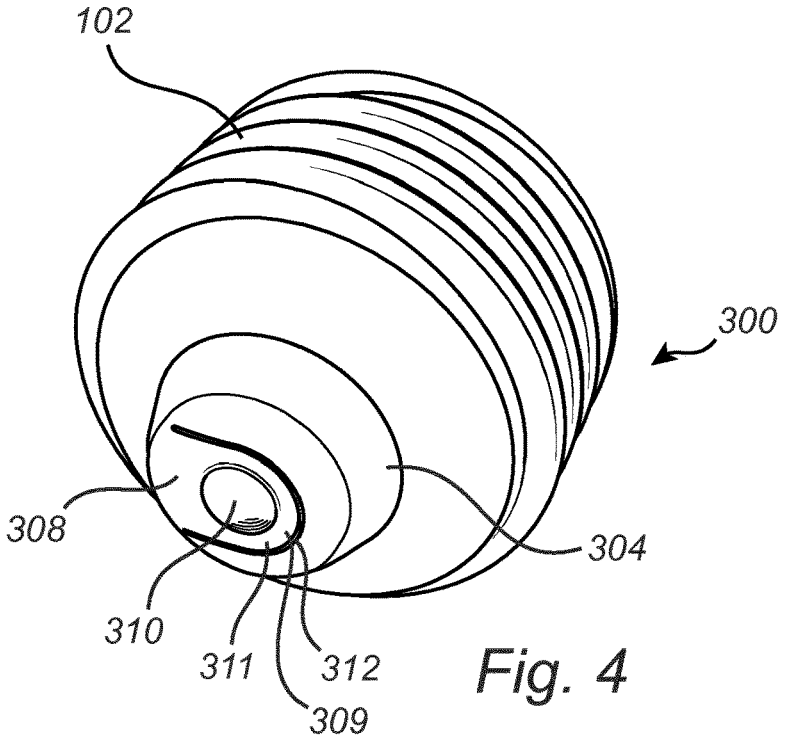
FIG. 4 illustrates a perspective view of the base disclosed in FIG. 3.

FIGS. 3 and 4 illustrate a screw-in type base 300, according to another embodiment of the present invention, for a lighting device being arranged to be mounted in a socket. FIG. 3 illustrates a cross-sectional side view of the base 300 and FIG. 4 illustrates the same base 300 in a perspective view.

The base 300 comprises an insulator 304 attached to the first end portion 102*a* of an enclosure 102. The insulator 304 has an inner portion 304*a* facing towards an inner space 306 of the enclosure 102 and an outer portion 304*b* facing away from the inner space 306. A compliant thin-walled member 308 is further arranged at the outer portion 304*b* of the insulator 304. The compliant thin-walled member 308 has a U-shaped channel 312 such that a resilient tongue 309 is formed. The tongue 309 further has a bulge 310 which facilitates an effective electrically conductive contact with the socket. The compliant thin-walled member 308 thereby forms a base bottom conductor 311. This arrangement reduces the building height needed to form the base 300.

The compliant thin-walled member 308 is further formed in a shell 313. The shell may thereby provide stability to the compliant thin-walled member 308. The shell 313 is cylindrical in shape and surrounds the tongue 309. The tongue 309 may thereby be formed by means of punching through the cylindrical shell 313. The shell 313 is further partly embedded in the insulator 304 which simplifies manufacturing of the base 300.

The resilient tongue 309 of the compliant thin-walled member 308 further biases the bulge 310 in such way that the bulge 310 is in an extended position 313 when no external force is applied to it.

As the compliant thin-walled member 308, i.e. the tongue 309 is resilient it is axially movable in relation to the tubular enclosure 102. When an external force is for example applied to the bulge 310, such as when the base 300 is mounted in the socket, the tongue 309 of the compliant thin-walled member 308 may bend. As a result, the bulge 310 reaches a compressed position 314. A base bottom conductor 311 is thereby provided such that the base 300 may be rotated in the socket maintaining electrically conductive contact between the base bottom conductor 311 and the socket bottom conductor of the socket.

Hence, the base bottom conductor 311 may be set in the extended position 315 and the compressed position 314 and any position there between. The distance between the extended position 315 and the compressed position 314 is preferably being large enough such that the base 300 of the lighting device may be rotated at least 180 degrees. In other words, the bulge 310 may move a distance that corresponds to at least half the height of the tread of the treaded tubular enclosure 102, without reducing or breaking the electrical contact between the base bottom conductor 311 and the socket bottom contact.

As describe above, depending on the symmetry of the lighting device, in another embodiment the distance between the extended position and the compressed position may be smaller than the above mentioned distance corresponding to at least half the height of the tread of the treaded tubular enclosure 102.

The skilled person in the art should understand that the compliant thin-walled member may be formed differentially than what is disclosed on FIGS. 3 and 4.

Figure 5:
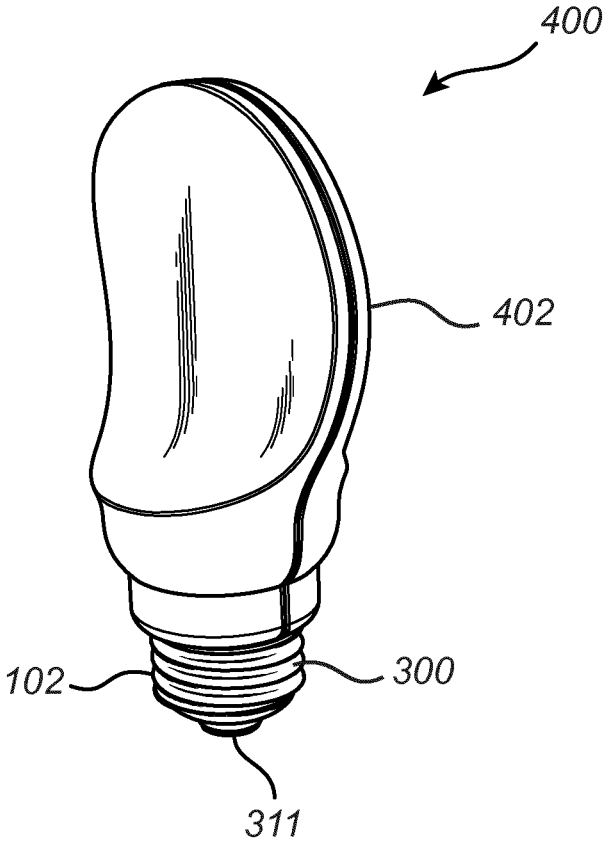
FIG. 5 illustrates a lighting device according to one embodiment of the present invention.

FIG. 5 illustrates a lighting device 400 according to one embodiment of the present invention. The lighting device 400 comprises a base 300 arranged to be mounted in a socket comprising a socket bottom conductor, not shown. The lighting device 400 further includes a lighting module 402, arranged on the base 300. The lighting module 402 comprises at least one light source, not shown. The lighting module 402 is asymmetric and as a consequence the lighting device 400 is rotationally asymmetric. The base 300 is the base disclosed above in relation to FIGS. 3 and 4. The base 300 comprises a tubular enclosure 102 and a base bottom conductor 311. The base bottom conductor 311 is axially movable, in relation to the tubular enclosure 102, such that the base 300 may be rotated after it is mounted in the socket without reducing or breaking the electrical contact between the base bottom conductor 311 and a socket bottom contact. It is thereby possible to rotationally adjust the position of the lighting device 400 by turning the base 300 in the socket, without reducing the efficiency of lighting device 400. The visual appearance, i.e., its rotational position may thereby be tuned by changing the rotational angle of the lighting device 400 in the socket. Hence, the lighting module 402 may be oriented in a preferred rotational direction.

According to another embodiment of the present invention a lighting device may be provided comprising a symmetric lighting module, but having a rotationally asymmetric light output. Again, by being able to rotationally adjust the position of the lighting device, by turning the base of the lighting device in the socket, the light emission from the lighting device may be tuned.

It should be noted that in other embodiments the base 300 may be any base according to the subject matter of the present invention. The person skilled in the art realizes that the present invention by no means is limited to the preferred embodiments described above. On the contrary, many modifications and variations are possible within the scope of the appended claims.

For example, the tubular enclosure and the base bottom conductor may consist of the same or different electrically conductive materials.

It should further be noted that the lighting device may comprise various types of light sources. For example, the lighting device may be a light emitting diode LED or an electric lamp comprising one or more halogen light sources.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A screw-in type base for a lighting device being arranged to be mounted in a socket comprising a socket bottom conductor, the base comprising:

a threaded tubular enclosure extending along an axial direction between a first end portion and a second end portion of the threaded tubular enclosure;

a base bottom conductor arranged to be in electrically conductive contact with a light source of the lighting device, and arranged to make electrically conductive, biased contact with the socket bottom conductor when the lighting device is mounted in the socket, and an insulator electrically insulating the threaded tubular enclosure and the base bottom conductor from each other, wherein the base bottom conductor comprises a compliant thin-walled member on at least a surface facing the socket bottom conductor arranged such that the base bottom conductor is, relative to the threaded tubular enclosure, movable in the axial direction and the compliant thin-walled member portion of the base bottom conductor is compliant in response to engagement with the socket bottom conductor when the lighting device is mounted in the socket and wherein the compliant thin-walled member is overmolded by the insulator.

2. The base according to claim 1, wherein the base bottom conductor is centrally arranged in the base.

3. The base according to claim 1, wherein the base bottom conductor is in electrically conductive contact with the light source of the lighting device via an electrically conductive wire.

4. The base according to claim 1, wherein the base bottom conductor further comprising an electrically conducting contact pin, and wherein:

the insulator is attached to the first end portion of the threaded tubular enclosure, the insulator having an inner portion facing towards an inner space of the threaded tubular enclosure, an outer portion facing away from said inner space, and a channel for receiving the electrically conducting contact pin, the channel extending from the outer portion, through the insulator and leading into the inner space, wherein the compliant thin-walled member is arranged in the inner space.

5. The base according to claim 4, wherein the contact pin is attached to the compliant thin-walled member.

6. The base according to claim 4, wherein the electrically conducting wire is attached to the contact pin.

7. The base according to claim 1, wherein the compliant thin-walled member comprises an electrically conducting material.

8. The base according to claim 7, wherein an electrically conducting wire is in electrical connection with the compliant thin-walled member.

9. The base according to claim 1, wherein:

the insulator is attached to the first end portion of the threaded tubular enclosure, the insulator having an inner portion facing towards an inner space of the threaded tubular enclosure and an outer portion facing away from said inner space, wherein the compliant thin-walled member is arranged at the outer portion of the insulator.

10. The base according to claim 9, wherein, the base further comprises a shell in which the compliant thin-walled member is formed.

11. A lighting device comprising the screw-in type base according to claim 1, and a lighting module arranged on the base.

* * * * *